US009693593B2

(12) United States Patent
Gomes De Paiva et al.

(10) Patent No.: US 9,693,593 B2
(45) Date of Patent: Jul. 4, 2017

(54) CLOTHING WITH INFLATION SYSTEM

(71) Applicant: DAMEL—CONFECAO DE VESTURARIO LDA, Povoa de Varzim (PT)

(72) Inventors: Vitor Manuel Gomes De Paiva, Povoa de Varzim (PT); Patricia Laura Da Silva Ferreira, Povoa de Varzim (PT); Gilda Maria Murta Santos, Vila Nova de Famalicao (PT)

(73) Assignee: DAMEL—CONFECAO DE VESTUARIO LDA, Povoa de Varzim (PT)

( * ) Notice: Subject to any disclaimer, the term of this patent is extended or adjusted under 35 U.S.C. 154(b) by 0 days.

(21) Appl. No.: 14/905,552

(22) PCT Filed: Jul. 21, 2014

(86) PCT No.: PCT/IB2014/063274

§ 371 (c)(1),
(2) Date: Jan. 15, 2016

(87) PCT Pub. No.: WO2015/011629

PCT Pub. Date: Jan. 29, 2015

(65) Prior Publication Data

US 2016/0150836 A1 Jun. 2, 2016

(30) Foreign Application Priority Data

Jul. 22, 2013 (PT) ..... 107074

(51) Int. Cl.

| | |
|---|---|
| ***A41D 13/012*** | (2006.01) |
| ***B63C 9/125*** | (2006.01) |
| ***A41D 13/01*** | (2006.01) |

(52) U.S. Cl.

CPC ..... *A41D 13/0125* (2013.01); *A41D 13/01* (2013.01); *B63C 9/1255* (2013.01)

(58) Field of Classification Search

CPC ..... A41D 13/0125; A41D 13/01; B63C 9/08; B63C 9/125; B63C 9/1255

USPC ..... 441/89, 96, 106, 108

See application file for complete search history.

(56) References Cited

U.S. PATENT DOCUMENTS

| | | | |
|---|---|---|---|
| 2,607,934 | A | 8/1952 | Bailhe |
| 7,059,924 | B2 | 6/2006 | Farmer et al. |
| 7,150,668 | B2 | 12/2006 | Kemp |
| 2004/0082237 | A1 | 4/2004 | Farmer et al. |

(Continued)

FOREIGN PATENT DOCUMENTS

| | | | |
|---|---|---|---|
| EP | 0023430 | A1 | 2/1981 |
| GB | 2250482 | A | 6/1992 |
| WO | 03/075692 | A1 | 9/2003 |

OTHER PUBLICATIONS

International Search Report dated Nov. 14, 2014 for PCT/IB2014/063274.

*Primary Examiner* — Lars A Olson

(74) *Attorney, Agent, or Firm* — Lucas & Mercanti, LLP

(57) ABSTRACT

The present application describes clothing that incorporates an inflation system for individual protection of permanent use. The integration method of the inflation system provides the garments to offer freedom of movement and be aesthetically appealing, allowing its use in various activities in the water and preventing death by drowning. This system can be directly applied to any type of clothing.

13 Claims, 9 Drawing Sheets

(56) References Cited

U.S. PATENT DOCUMENTS

| | | | | |
|---|---|---|---|---|
| 2005/0101203 | A1* | 5/2005 | Kemp | B63C 9/125<br>441/106 |
| 2008/0268731 | A1* | 10/2008 | Lahyani | A41D 7/003<br>441/89 |

* cited by examiner

CLOTHING WITH INFLATION SYSTEM

CROSS REFERENCE TO RELATED APPLICATION

This Application is a 371 of PCT/IB2014/063274 filed on Jul. 21, 2014 which, in turn, claimed the priority of Portuguese Patent Application No. 107074 filed on Jul. 22, 2013, both applications are incorporated herein by reference.

TECHNICAL DOMAIN

The present application describes clothing that incorporates an inflation system.

BACKGROUND

The individual flotation devices known in the art are bulky, heavy and very little ergonomic—its use, usually over the clothing of the user, inhibits the user of certain tasks, often leading to its non-use.

Also known are flotation systems wherein the inflation system is disposed on the inside of clothing, being in contact with the body. This type of flotation systems involves discomfort and leads the user to use a garment larger than necessary in order to be able to allocate the volume of the inflation chamber(s), being misplaced and making the movements difficult, causing hazardous conditions for the user.

On the contrary, the clothing now presented avoids the need to use individual flotation devices, since it has the inflation system integrated on the outer part, allowing greater mobility for the performance of tasks inherent to the various activities in water as well as its permanent use.

EP0023430A1 discloses a jacket with inflation chambers placed inside, between two impermeable layers. Inflation is ensured by a chamber comprising two front members that join on the cervical region providing inflation in that zone and that is fixed by a belt that connects the two front members with a buckle that passes through the outside thereof and in the user's back. This system is housed within the jacket.

Document U.S. Pat. No. 2,607,934 describes a jacket with pockets on the inside, that close with springs, and in the collar for insertion of the inflation chamber. The inflation system used is a tube for oral inflation, however another method may be used. The fit to the user's waist is made with cord. The inflation chamber can be used alone, without the jacket, or with the jacket.

Document U.S. Pat. No. 7,059,924 describes an individual flotation device that can be used as a single piece, or integrated into the interior portion of another, for example a vest or jacket, through a system of closures.

U.S. Pat. No. 7,150,668 describes a t-shirt to water sports practitioners like surfing, sports like kayaking, sailing, among others containing inflation chamber placed in its interior, which can be activated in case of emergency.

SUMMARY

Although there are already solutions for individual flotation devices, whether for use alone or for use in conjunction with garments, it appears that none of them presents or give clues as to a solution to get ergonomic, functional and comfortable clothing, in order to not jeopardize the proper performance of the tasks and activities of the users, allowing its permanent use. Thus, the integration of the floating element on the outside of clothing eliminates the need of the clothing to be much looser than necessary, reducing the risk of accidents caused by the use of clothing that is too loose.

The present application discloses a garment comprising the following elements:

- at least one inflation chamber connected to a gas cylinder;
- a system of straps that allows the inflation chamber to be operational even if the garment is damaged, in which said straps are coupled to said inflation chamber from the front part of the waist to the belt at the back, ending with a ring forming the loops;
- cover comprised by a front part, a rear part and a collar part that are joined by a closure system;
- at least one maniple for manual activation;
- closure system and adjustment integrated into the belt;
- at least one humidity sensor, consisting preferably of paper or other hygroscopic material that increases in volume upon contact with water.

In an embodiment, the inflation chamber coupled to the garment is activated in an automatic, manual or oral mode.

In another embodiment, the gas used for the filling of the inflation chamber is carbon dioxide.

In yet another embodiment, the straps used in garments have a minimum width of 40 mm.

In an embodiment, the loop used in clothing is sewn on fabric.

In another embodiment, the shape and cut of the clothing cover has no overlaps or tight corners or edges/enclosures.

In yet another embodiment, the inflation chamber of the clothing is fixed to said clothing at the neckline zone and front loop of the belt.

In an embodiment, the front part of the inflation chamber used in clothing features a protection panel to the gas cylinder and to the manual/automatic inflation system.

In another embodiment, the protection panel of the clothing presents an information area on its opposite side.

In yet another embodiment, the clothing comprises a handle to hoist fixed to the protection panel.

In an embodiment, the clothing comprises a whistle.

In another embodiment, the clothing comprises an emergency light and respective activation system.

In yet another embodiment, the clothing comprises reflective tapes, preferably with a minimum area of not less than 300 $cm^2$.

DESCRIPTION

The present embodiment relates to clothing that includes an inflation system for personal protection of permanent use. This system can be directly applied to any type of clothing. The integration method of the inflation system provides the garments to offer freedom of movement and be aesthetically appealing, allowing its use in various activities in the water preventing death by drowning.

The clothing has at least one integrated inflation chamber, which can be activated in case of fall into the water in an automatic, manual or oral mode. The automatic inflation occurs upon contact with water, with a release of gas, for example carbon dioxide, needed to inflate the floating chamber. With the inflation of the chamber, the user, even unconscious, is placed and kept in the safe position, as defined by the standard ISO 12042, with the face out of the water, ensuring his survival. The device presents a humidity sensor, consisting preferably of paper or other hygroscopic material that increases in volume upon contact with water. When this contact occurs with a humidity source, a spring system is triggered which causes the gas cylinder to be pierced, releasing the gas into the inflation chamber. The system also has a manual activation device, which allows releasing the gas into the chamber and a tube for oral inflation, which allows the user to fill the chamber with air. Clothing which includes this system is intended for recreational/leisure and professional activities, such as water sports, sailing, fishing, among others. The clothing is worn easily without any restriction and is adjusted to the user, for example through the closure and adjustment system in the waist area. The replacement of the inflation system used is very easy being only necessary to swap the gas cylinder and the detector of the contact with water.

This type of integration of the inflation system allows obtaining ergonomic, comfortable clothing and also provides the user with a guarantee of safety in case of fall in water, without this compromising the normal execution of its tasks and activities. Furthermore, the form of integration of the inflation chamber causes the system to be imperceptible at a glance since the inflation chamber is hidden in the bag that is made of the same material as the rest of the garment, allowing that this type of protective clothing to present a pleasing aesthetic appearance, encouraging its permanent use.

This protective clothing is designed with waterproof, breathable materials, with mechanical strength that allows the user's protection against environmental conditions of use. Moreover, the method of integration of the inflation system in combination with its shape of coverage, allows the protection of the inflation chamber from the possible damage arising from the activities, for example the risk of perforation by sharp materials/objects and spiked as hooks, harpoons or others. This integration method was developed so that the inflation chamber is disposed on the outside of the garment but totally integrated in a scheme of straps that gives the assurance that even if the clothing is damaged the chamber will continue operating and will not be separated from the user. The strap system was developed to pass through the shoulder of the user and go to the front and rear waist area engaging in the strap that also surrounds the trunk at the waist area. The straps are fixed at the waist area at the back and sewn on the front part, from the shoulder to the waist. The chamber is only fixed in the neckline area. Also the shape of cover was designed to completely cover the chamber and all its components, ensuring that it is not damaged as there is no contact with the outside.

The inflation chamber 114 is integrated in the garment in a concealed manner, by means of a strap system specifically designed for this purpose combining safety and aesthetics, being only visible a cover 201 and 303, as shown in FIGS. 1, 2 and 3, as well as the other components of the system, namely the automatic/manual inflation system 108 and oral inflation system 105, at least one maniple for manual activation 111, gas cylinder 107, whistle 103 and cord 106, emergency light 104 and respective emergency light activation system 113 and reflective tapes 102, conferring an appealing design. All components used shall meet the requirements for use in individual flotation devices.

BRIEF DESCRIPTION OF THE FIGURES

For an easier understanding of the embodiment join the attached figures, which represent preferred embodiments that, however, are not intended to limit the scope of this embodiment.

201—Cover;
202—Closure and adjustment system;
301—Loops for passing the belt—back;
302—Belt;
303—Cover

101—Hoist handle;
102—Reflective tapes;
103—Whistle;
104—Emergency Light;
105—System of oral inflation;
106—Cord;
107—Gas cylinder;
108—Automatic/manual inflation system;
110—Information panel;
111—Maniple for manual activation;
112—Protection panel to the gas cylinder and to the automatic/manual inflation system;
113—Emergency light activation system;
114—Inflation chamber.

Figure 5:
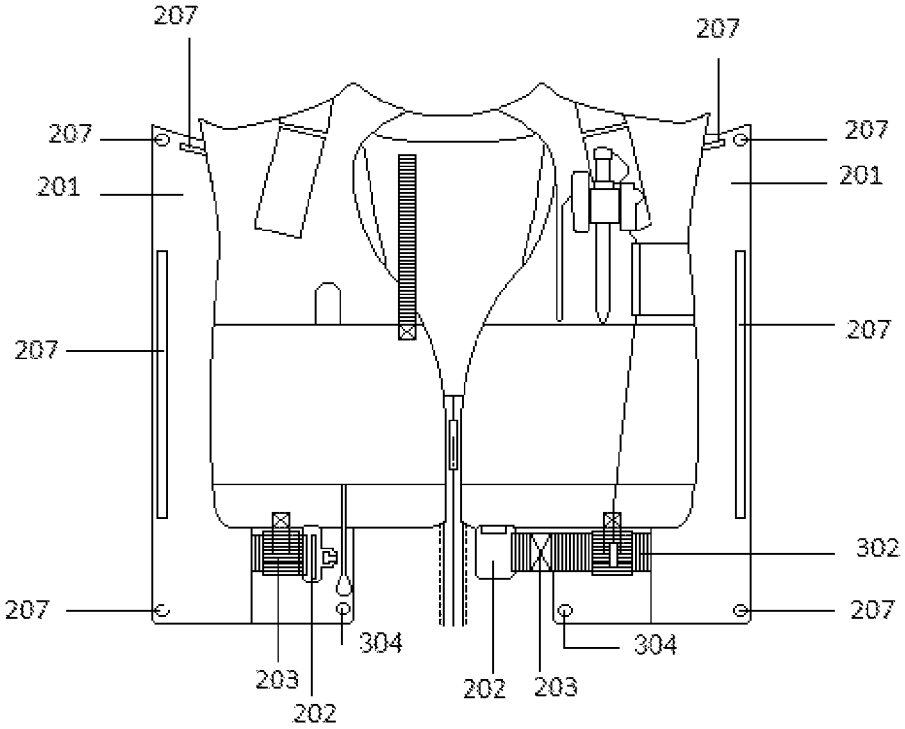
Figure 6:
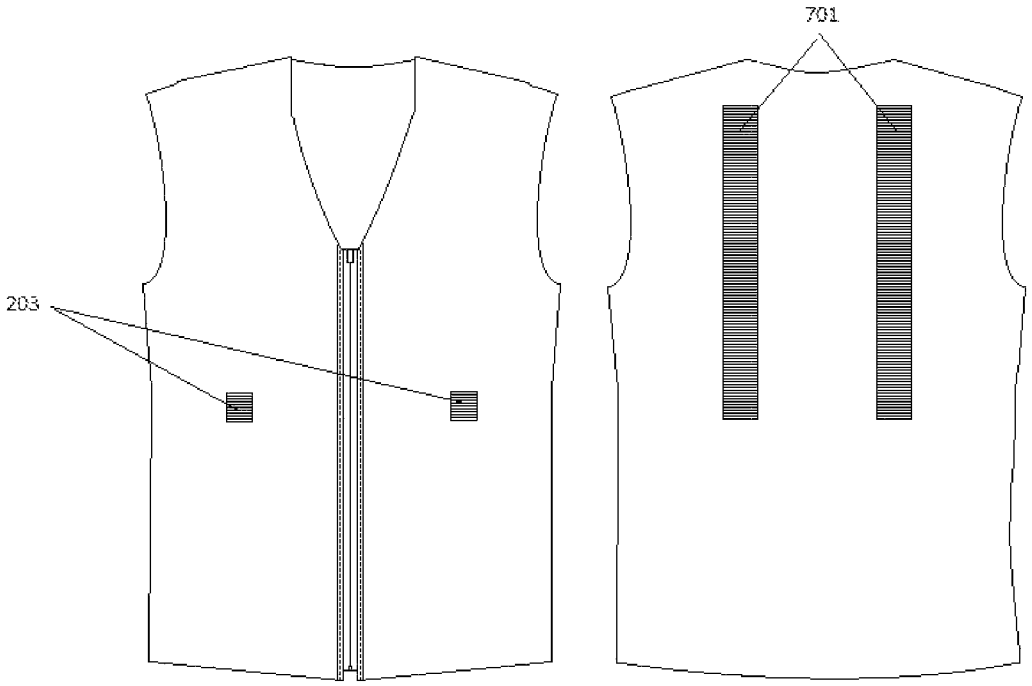

FIG. 5 shows an embodiment of the integrated buoy, wherein the reference numbers represent:

201—Cover;
202—Closure and adjustment system;
203—Loops for passing the belt—front;
207—Adhesive tape;
302—Belt;
304—Adhesive tape FIG. 6 shows an embodiment of the hoist handle system on the reverse side, where the reference numbers represent:

203—Loops for passaging the belt—front;
701—Hoist system—back side back.

Figure 7:
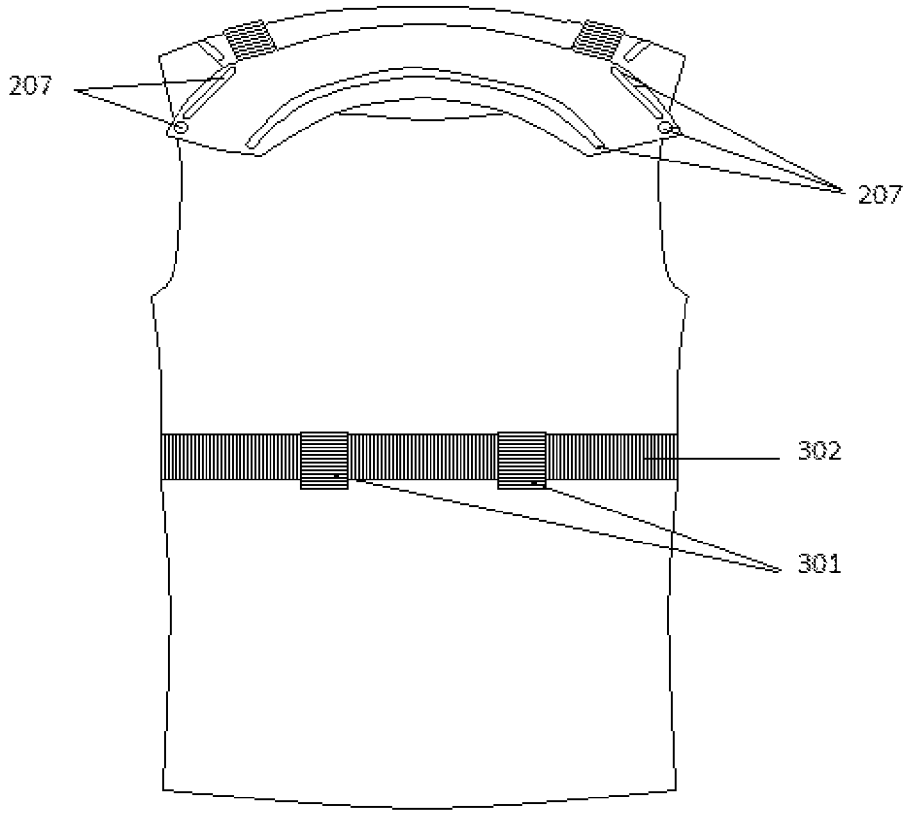

FIG. 7 shows an embodiment of a panel open side of the rear panel, wherein the reference numbers represent:

207—Adhesive tape;
301—Loops for passing the belt—back;
302—Belt.

Figure 8:
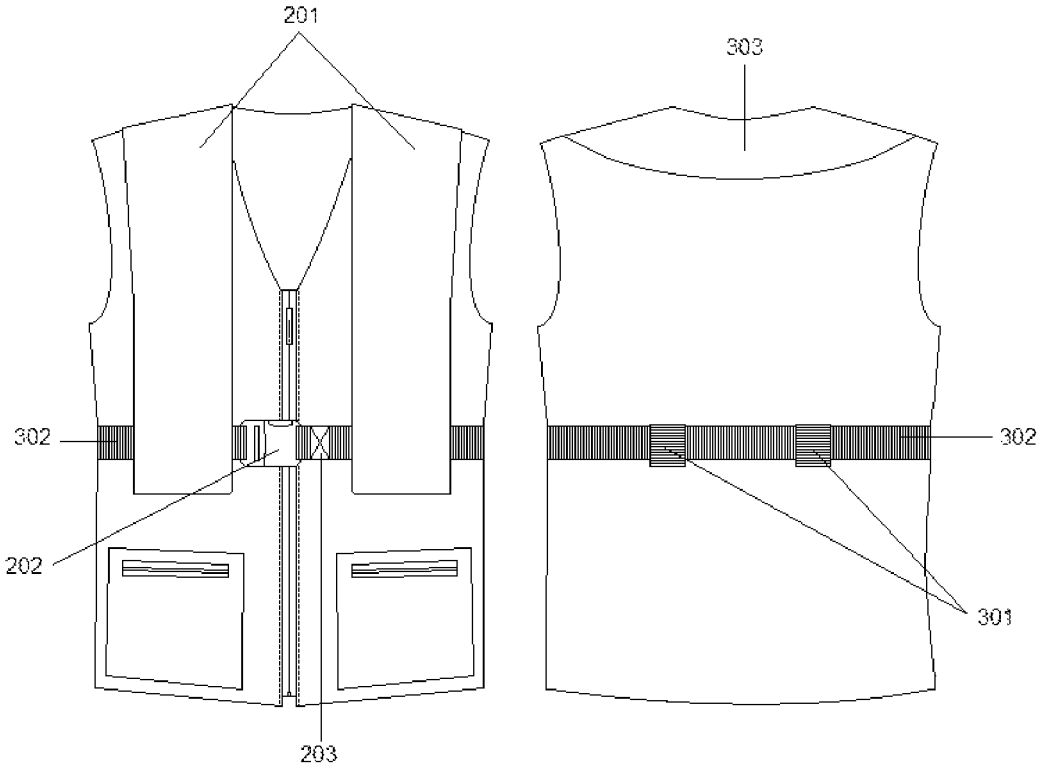

FIG. 8 shows an embodiment of an outer design of the front and rear side, wherein the reference numbers represent:

201—Cover;
202—Closure and adjustment system;
203—Loops for passing the belt—front;
301—Loops for passing the belt—back;
302—Belt;
303—Cover.

Figure 9:
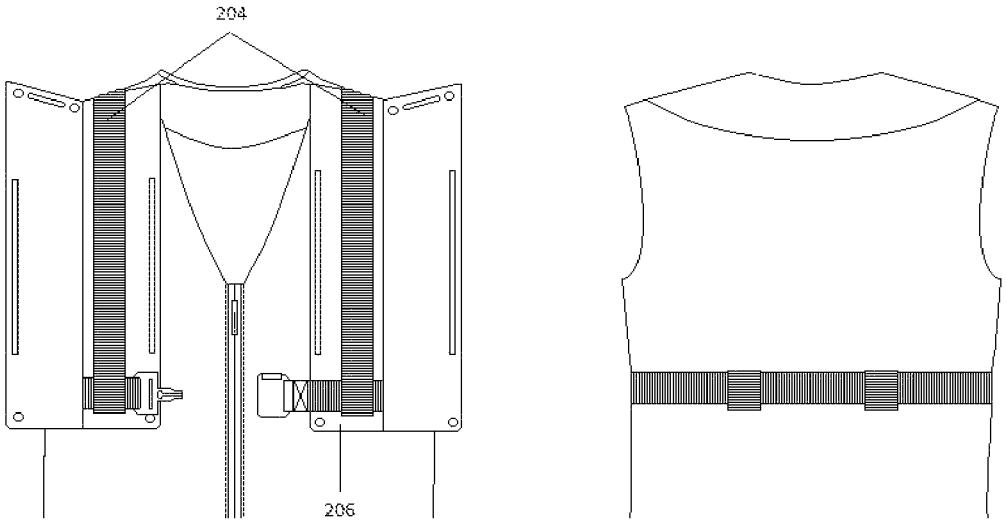

FIG. 9 shows an embodiment of a hoists system of the right side, wherein the reference numbers represents:

204—Loop system—front;
206—Fabric structure.

DETAILED DESCRIPTION

The design and conception of the garments were carefully defined and took into account the requirements for individual flotation devices of the ISO 12042 standard of 2006, so that clothing combines the ergonomic and functional features to the conditions of protection and safety during their use and in the event of an accident.

In this sense, a specific system of straps covering the entire trunk of the user was developed. This system consists of straps with a minimum width of 40 mm, and minimum tensile strength of 1600N adequate to support the required load, sewn from the waist in the front—loops system—front 204—until the belt back—hoist system—back side back 701, as seen in FIGS. 9 and 6 respectively, ending with a ring to form the loops for passing the belt—front 203 and loops for passing the belt—back 301, built by straps with adequate strength at front and back. The loop is sewn on the fabric structure 206 with the proper resistance and hence resistant to tear and load requirements The handle system described previously is fixed to a fabric structure 206 with adequate strength allowing that, in case of damage of the base fabric, the user continues with the inflation chamber 114 placed and operating.

The covers visible in FIG. 8 mentioned above have dual function—to protect and conceal—the inflation chamber 114. The covers are double, being the inner layer of fabric structure 206 to protect the chamber against possible damage that may jeopardize its functionality and the outer layer is fabric that meets the aesthetic and functional requirements of clothing to stay concealed.

The cover consists of three parts, namely one in each front 201 and one in the neck 303, that closes by means of a closure system, such as with adhesive tape 207 and adhesive tape 304, spring, closure or other fastener that allows a rapid opening without requiring user intervention, preferably disposed as illustrated in FIGS. 5 and 7 or other appropriate means. Their shape and cuts were studied to allow their fast opening when the inflation chamber 114 begins to be inflated, i.e. has no overlap or tight corners or edges/enclosures.

With regard to the safety position, clothing ensures that it is maintained in the event of an accident. Once activated, the inflation chamber 114 provides lateral occipital and support to the wearer's head, for the mouth to be out of water, even in the event of loss of consciousness. The body is inclined backward with respect to an axis perpendicular to the water surface in an angle of 30 to 90°, and an angle from the plane of rest of from 40 to 90°. Furthermore, preventing the face to be pointed towards the water. To meet this requirement, the inflation chamber 114 is fixed to the clothing in the neckline, upper part of the chamber, and also in the loop to the belt passage—front 203, one on each side, at the bottom part of the chamber.

The position of the belt 302 was critically defined as being the appropriate to not allow the clothing go up inside the water and thus change the position of the user. The handle system that surrounds the trunk of the user, and the belt 302 that surrounds it ensure that the garment remains adjusted to the inflation chamber 114 correctly positioned.

The front part of the inflation chamber 114 has a protection panel to protect the gas cylinder and the automatic/manual inflation system 112 that is sewn on one side, strategically placed on the automatic/manual inflation system to prevent the system to be activated in case of rain. It also has the function of supporting the handle to hoist 101 and serve as information area. This panel should be constructed with the same material as the inflation chamber 114 and the seam should be done using a line that supports the required loads. On the other side lies an information panel 110 with information area. The information area should contain instructions for use and maintenance of the automatic, manual and oral inflation system, and other relevant information.

The clothing has a handle to hoist 101 fixed by the appropriate means to the protection panel on the gas cylinder and the automatic/manual inflation system 112 composed by material resistant to putrefaction and to the appropriate loads to support the user.

The clothing has integrated an emergency light 104 that is activated upon fall in the water to make the user visible even in low light and at a considerable distance.

Figure 4:
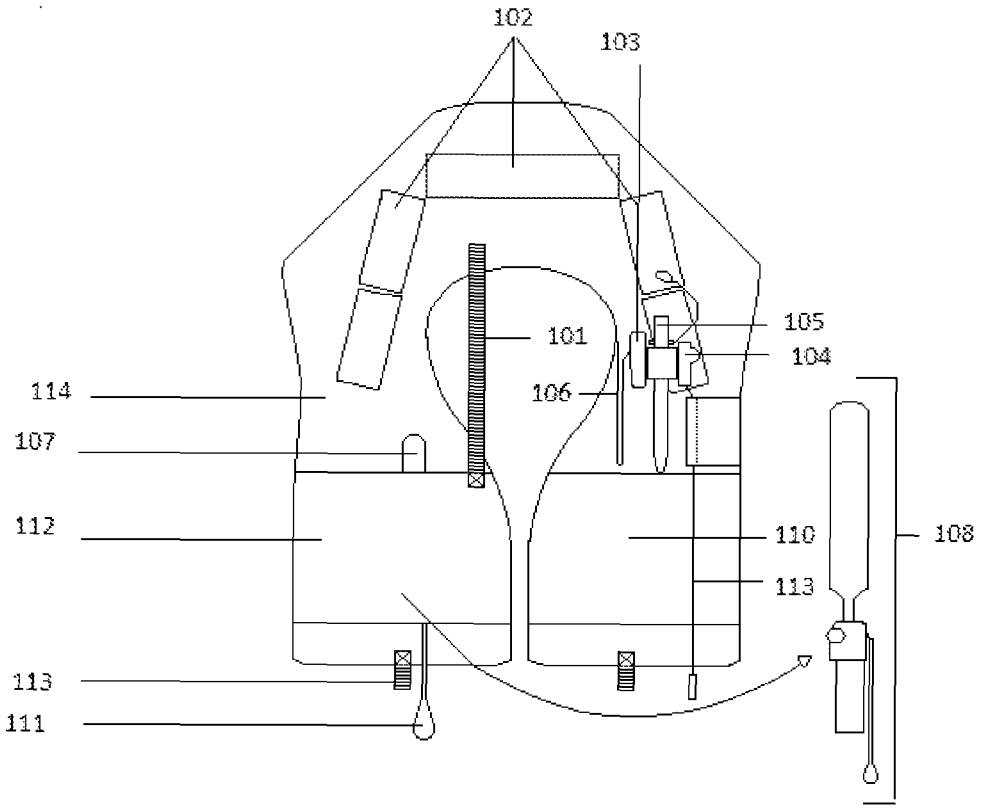
FIG. 4 shows an embodiment of the buoy and of the final inflation system, wherein the reference numbers represent.

Reflective tapes 102 of high visibility were also glued in the inflation chamber 114, in order to increase the visibility of the user in case of fall into the water. The disposition of the reflective tapes 102 may be visualized in FIG. 4 or other more appropriate, assuming its minimum area is not less than 300 $cm^2$.

The automatic/manual inflator system 108 has two ways of operation: automatic upon contact with water and manual, in case of failure of the automatic system, by mechanical means pulling up at least one maniple for manual activation 111.

There is also the oral inflator system 105 that can be used in case of failure of the automatic/manual inflation system 108.

The garment has a closure and adjustment system 202 incorporated in the belt 302 that allows to do the appropriate adjustment to the user.

Exemplary Embodiment

Figure 1:
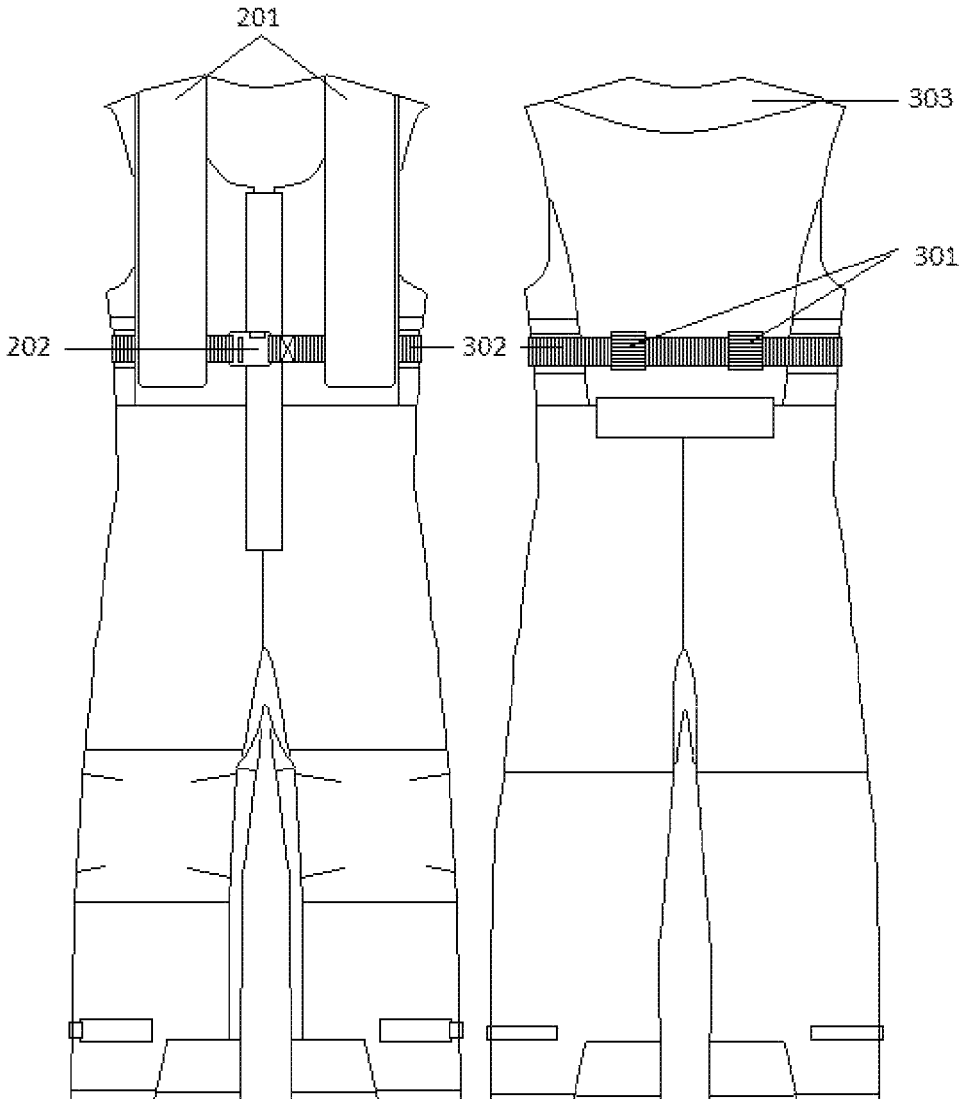
FIG. 1 shows an embodiment of the overall in front and rear view, in which reference numbers represent.

FIG. 1 illustrates a front view and back of one embodiment of the outside integration method of inflation systems in clothing for personal protection of permanent view. The illustrated piece is an overall that contains the inflation chamber 114 integrated as described above. In FIG. 1 it is possible to see the cover 201 and 303, which protects and conceals the inflation chamber 114. Cover 201 and 303 is double, the inner layer being in a fabric structure 206, resistant to the load and tear requirements, yet fulfilling the aesthetic and functional requirements of the garment. It is also visible the closure and adjustment system 202 incorporated in the belt 302.

Figure 2:
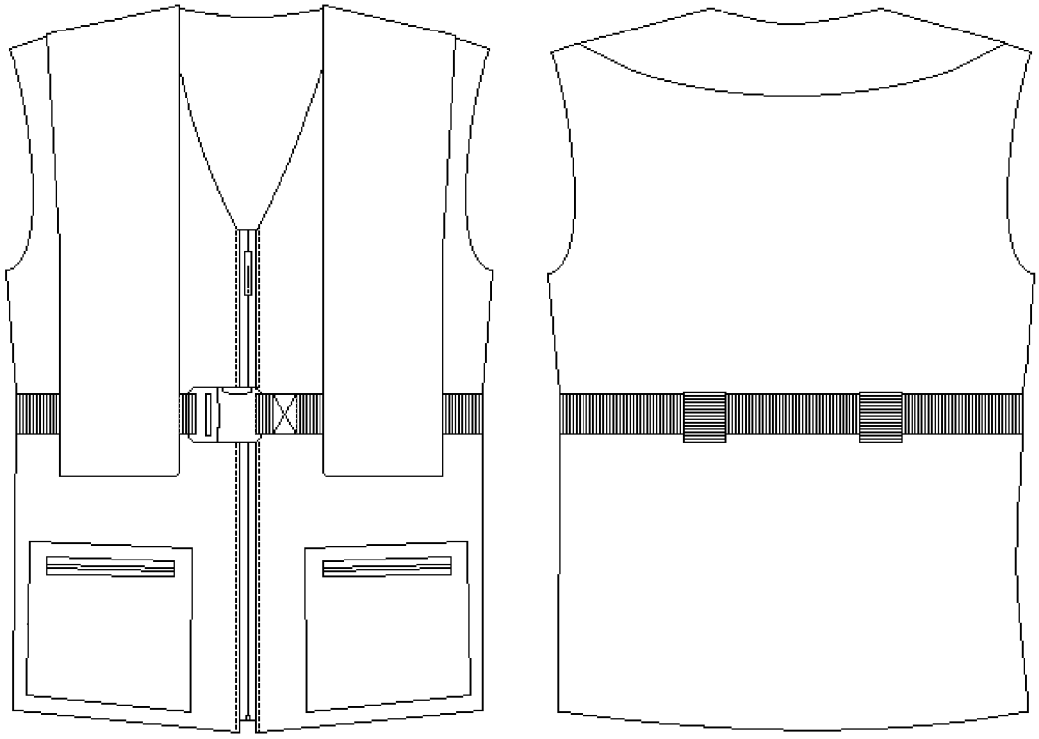
FIG. 2 shows an embodiment of a vest.
Figure 3:
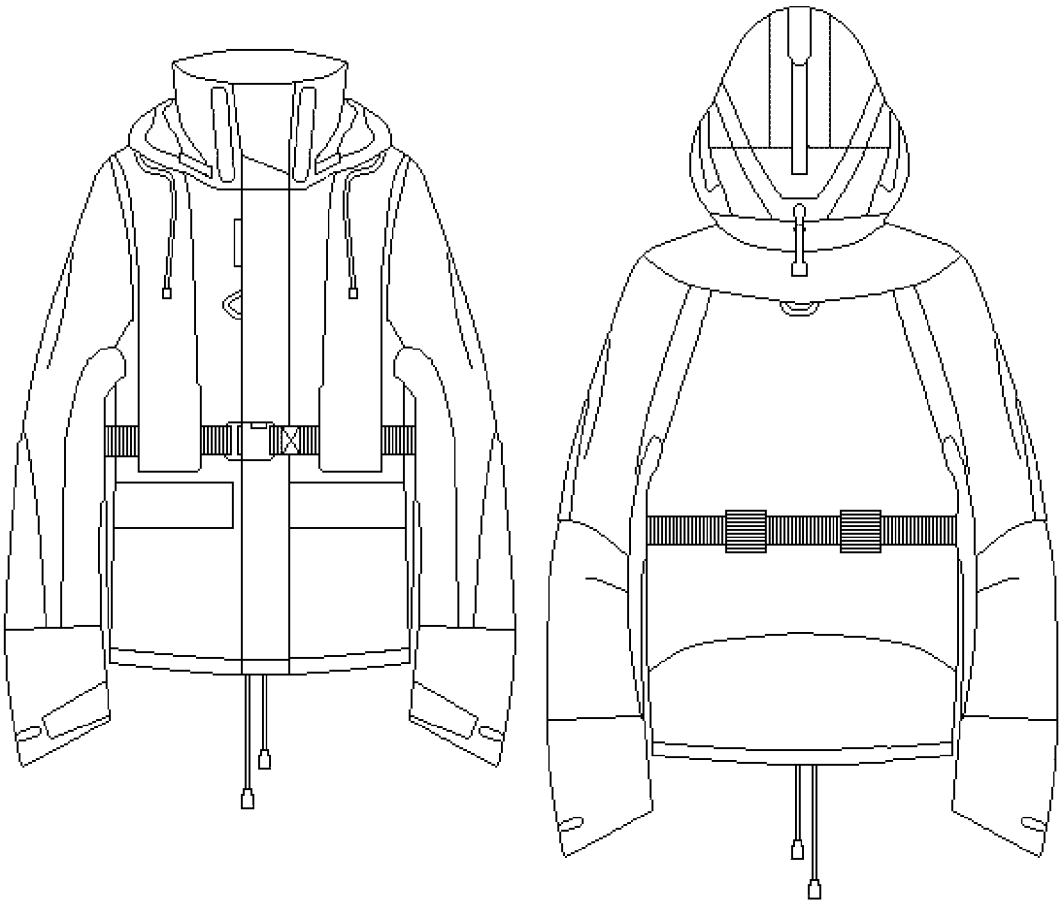
FIG. 3 shows an embodiment of a jacket in front and rear views.

FIGS. 2 and 3 shows examples of other possible embodiments for the method for outside integration of inflation systems in clothing for individual protection of permanent use. However, the method can be used to incorporate inflation systems on other types of garments.

The garment has a closure and adjustment system 202 integrated in the belt 302, that the user must use to properly adjust the piece. When the user falls in the water the automatic/manual system 108 is activated by releasing the gas from the gas cylinder 107 to the inflation chamber 114, inflating it.

In case the automated system fails, the user can still use the manual system by pulling the maniple for manual activation 111 that will release the gas into the inflation chamber 114.

The user can also inflate the inflation chamber 114 through the oral inflation system 105.

The clothing has integrated an emergency light 104 that is activated upon the fall in the water to make the user visible even in low light and at a considerable distance.

The user also has a whistle 103 to signal its presence in water and thus increase the possibility of rescue.

This embodiment is not, naturally, in any way restricted to the embodiments described herein and a person with average skills in the area can provide many possibilities for changes without departing from the general idea, as defined in the claims.

The preferred embodiments described above are obviously combinable with each other. The following claims define further preferred embodiments

The invention claimed is:

1. A clothing system comprising the following elements:

a garment;

a cover comprising a front part, a rear part and a neck part that are joined by a closure system;

at least one inflation chamber disposed on the outside of the clothing, the at least one inflation chamber being connected to a gas cylinder, the at least one inflation chamber having:

a front side, a back side, first and second shoulder regions, a neckline region, and a waist region; and a plurality of loops attached to the at waist region of the at least one inflation chamber, the plurality of loops including at least a first loop disposed on the front part of the at least one inflation chamber and a second loop disposed on the front part of the at least one inflation chamber;

a belt adapted to pass through the plurality of loops;

a plurality of straps, wherein said plurality of straps includes at least a first strap that is coupled to the first loop, passes over the first shoulder region, and is coupled to a first portion of the belt proximate the back side of the at least one inflation chamber, and a second strap that is coupled to the second loop, passes over the second shoulder region, and is coupled to a second portion of the belt proximate the back side of the at least one inflation chamber;

at least one maniple for manual activation;

a closure and adjustment system incorporated in the belt;

at least one humidity sensor adapted to increase in volume upon contact with water.

2. The clothing system according to claim 1, wherein the inflation chamber is activated in one of an automatic, manual or oral mode.

3. The clothing system according to claim 1, wherein the gas cylinder holds carbon dioxide.

4. The clothing system according to claim 1, wherein each strap in the plurality of straps has a width of at least 40 mm.

5. The clothing system according to claim 1, wherein the closure and adjustment system is sewn on a fabric structure of the garment.

6. The clothing system according to claim 1, wherein a shape and cut of the cover has no overlaps, tight corners, edges or enclosures.

7. The clothing system according to claim 1, wherein [the neckline region of] the inflation chamber is fixed to the garment and the first loop of the belt of the inflation chamber is fixed to the garment.

8. The clothing system according to claim 1, wherein the front side of the inflation chamber comprises a protection panel adapted to protect the gas cylinder and to the automatic/manual inflation system.

9. The clothing system according to claim 8, wherein the protection panel further comprises an information area.

10. The clothing system according to claim 8, the clothing system further comprising a handle adapted fixed to the protection panel.

11. The clothing system according to claim 1, further comprising a whistle.

12. The clothing system according to claim 1, further comprising an emergency light and an emergency light activation system.

13. The clothing system according to claim 1, further comprising reflective tape having an area of not less than 300 $cm^2$.

* * * * *